US006629405B2

(12) United States Patent
Johnson

(10) Patent No.: US 6,629,405 B2
(45) Date of Patent: Oct. 7, 2003

(54) WESTERN STYLE STIRRUP WITH INTERNAL SPRINGS

(76) Inventor: Johnny E. Johnson, 2107 Turner St., Ponca City, OK (US) 74604

( * ) Notice: Subject to any disclaimer, the term of this patent is extended or adjusted under 35 U.S.C. 154(b) by 0 days.

(21) Appl. No.: 10/065,010

(22) Filed: Sep. 9, 2002

(65) Prior Publication Data

US 2003/0051448 A1 Mar. 20, 2003

Related U.S. Application Data

(60) Provisional application No. 60/322,111, filed on Sep. 14, 2001.

(51) Int. Cl.[7] ..... B68C 3/00
(52) U.S. Cl. ..... 54/48
(58) Field of Search ..... 54/47, 48; D30/142

(56) References Cited

U.S. PATENT DOCUMENTS 565,478 A * 8/1896 Long ..... 54/48
652,805 A * 7/1900 Neal ..... 54/48
704,184 A * 7/1902 Gillespie ..... 54/48
745,332 A * 12/1903 Dowell ..... 54/48
1,079,813 A * 11/1913 Van Zante ..... 54/48
1,197,681 A * 9/1916 Stine ..... 54/48
6,220,004 B1 * 4/2001 Hsi-Chang ..... 54/48

* cited by examiner

*Primary Examiner*—Michael J. Carone
*Assistant Examiner*—Elizabeth Shaw
(74) *Attorney, Agent, or Firm*—Martin S. High

(57) ABSTRACT

The instant invention is a western style stirrup with a plurality of internal springs to lessen the normal vibration, impact and shock normally encountered when riding a horse. Four springs are mounted internally to the stirrup. The spring apparatus is connected to a riser by means of a hook end on the springs. The riser is connected through a connection means, weld, threaded or non-threaded connection means, to a riser bar. The riser bar is the portion of the instant invention that is connected to the saddle through the common leatherwork used in saddles. The function of the riser bar is to transfer force from the stirrup to the saddle. The four internal springs in the stirrup transfer the force from the foot of the rider via the stirrup body to the riser bar.

4 Claims, 3 Drawing Sheets

WESTERN STYLE STIRRUP WITH INTERNAL SPRINGS

CROSS REFERENCE TO RELATED APPLICATIONS

This invention claims benefit of U.S. Provisional Application No. 60/322,111, which was filed on Sep. 14, 2001

BACKGROUND OF INVENTION

The field of the instant invention is the general area of equestrian sports. Specifically, the invention is a type of "Western style" stirrup with an internal spring mechanism to reduce the natural impact of the weight of the rider upon the horse as the horse walks or runs. When a rider mounts and rides a horse, the rider's feet are placed inside stirrups, one stirrup on each side of the horse. The stirrup is one of the rider's connections to the horse and is a conduit for forces to be transmitted from the rider to the horse and from the horse to the rider. In general, the equestrian community recognizes two major styles of stirrup: English stirrups and Western stirrups. The instant invention is directed toward the manufacture and use of a novel type of Western stirrup that uses internally placed springs to lessen the shock of normal riding conditions.

With only a passing knowledge of the history of the United States one would realize that horses and horse riding has played an important role in the development of the nation. As one would expect the amount of prior art dedicated to equestrian sports is large. The prior art that is pertinent to the general area of the instant invention, stirrups, is correspondingly smaller. The most pertinent art will be discussed briefly below distinguishing the various approaches to solving the problem addressed by the instant invention.

The invention by Southworth (U.S. Pat. No. 807,000) ('000) teaches a stirrup containing a single spring acting to modulate the impact of the rider on the horse. This spring is located between two horizontal cross-bars. The cross-bars are located above the rider's foot resting on the bottom of the stirrup. The instant invention seeks to avoid the problem of having multiple horizontal cross bars which limit the stroke of the cushioning spring, and allow for a plurality of vertical springs to further modulate the force exerted on the stirrup. Further, the '000 invention may possibly capture the side of the horse or the rider in the vertical motion of the spring action injuring the horse or the rider. Lastly, the '000 invention teaches a more English-style type of stirrup instead of the more rugged, but less aesthetic, western-style stirrup.

U.S. Pat. No. 2,935,833 ('833) by Woodhead teaches a device attached to a stirrup that uses springs between the stirrup and the connection point on the saddle. The drawback with the invention described in the '833 patent is that the springs are external to the stirrup. With the external springs, the device has a large possibility of rubbing against the horse's side increasing the potential for injury. Further the instant invention encloses the springs in the stirrup resulting in a more aesthetic and economical solution.

U.S. Pat. No. 3,512,339 ('339) by Roberts teaches a stirrup consisting of a two springs within an assembly which is placed. The '339 patent teaches a stirrup within a tubular sleeve to absorb the forces on the stirrup. The tubular sleeve is located between the saddle strap and a horizontal stirrup bolt. This combination is very similar to that of the '000 invention discussed above and has similar disadvantages. First, the '339 and the '000 invention unnecessarily increases the height of the stirrup to accommodate the springs. Second, the '339 and '000 inventions have limited space for additional springs or more robust springs to accommodate heavier riders or for riding in more difficult terrain.

Jones teaches in U.S. Pat. No. 4,936,081 ('081) a device similar to the '339 and '000 inventions in that a shock absorbing material in the top portion of the stirrup. In '081, the shock absorbing structure is comprised of elastomeric material. However, the '081 patent also unnecessarily increases the overall height of the stirrup, a disadvantage overcome by the design of the instant invention. Using elastomers to modulate shock and vibration is also not as effective as the use of springs as in the instant invention, but can be used in tandem with springs to eliminate lower amplitude vibrations.

U.S. Pat. No. 6,220,004 ('004) by His-Chang is an English-style stirrup with a spring located on both sides of the stirrup. The springs are located within the stirrup body not between the saddle attachment and the stirrup as in the '000, '339 and '081 inventions discussed above. The instant invention, unlike the '004 invention, seeks to employ spring modulation for a Western-style stirrup and allow for a plurality of springs within the stirrup.

Other teachings such as U.S. Pat. No. 6,425,230 by V ö llmecke have proposed placing shock absorbing materials in the footrest of the stirrup body to modulate the forces upon the stirrup. The nature of horseback riding when employing Western-style stirrups commonly involves riding over extremely rough terrain. The forces upon stirrups involved in this type of riding requires a means of modulating stress that exceeds that of simply placing elastic materials in the footrest of the stirrup. The instant invention employs a plurality of springs internal to the stirrup body.

In summary, the instant invention seeks to modulate the forces transmitted to the horse by the rider through a plurality of springs in a western-style stirrup. The instant invention seeks to perform this task in a manner as to obviate the possibility of injury to the rider and the horse.

SUMMARY OF INVENTION

The instant invention is a western style stirrup with internal springs to lessen the normal vibration, impact and shock normally encountered when riding a horse. The lessened shock is beneficial to both the rider and the horse. The rider's feet and therefore the rider's ankles, lower leg, upper leg, buttocks, and back benefit from the modulated vibrations, impact and shock due to the use of springs in the stirrup. The animal benefits by minimizing or reducing the magnitude of the impact to the saddle, and, therefore, by extension, the animal's back, spine and legs benefit.

A plurality of springs are mounted internally to the stirrup; two on each side of a stirrup frame being a preferred embodiment. The mechanism of the spring action is normally covered by leather, cloth, polymeric material or other suitable covering commonly used to cover traditional western-style stirrups not using springs or spring mechanisms. Indeed, it is common for the entire stirrup to be covered in a material to protect the horse and the rider from any sharp edges on the stirrup or repeated striking of blunt surfaces. The top portion of the spring apparatus is connected to a riser by means of a hook end on the springs. The riser is connected through a weld or threaded or non-threaded connection means to a riser bar. The riser bar is the portion of the instant invention that is connected to the saddle through the common leatherwork used in saddles.

The function of the riser bar is to transfer force from the stirrup to the saddle. The four internal springs in the stirrup transfer the force from the foot of the rider via the stirrup body to the riser bar. The bottom portion of the spring apparatus is fixed to the stirrup. The force of the impact of the rider upon the horse is transmitted through the riders boots and in turn through the stirrups. The extension of the spring mechanism reduces the amount of energy transmitted to the horse through the leatherwork connecting the stirrup to the saddle.

In summary, the instant invention is a leather covered, western style stirrup comprised of internal springs to transfer the force from the rider's foot through the stirrup to the saddle in a manner that is more comfortable and safer that conventional western stirrups not containing a spring mechanism.

DETAILED DESCRIPTION

Figure 1:
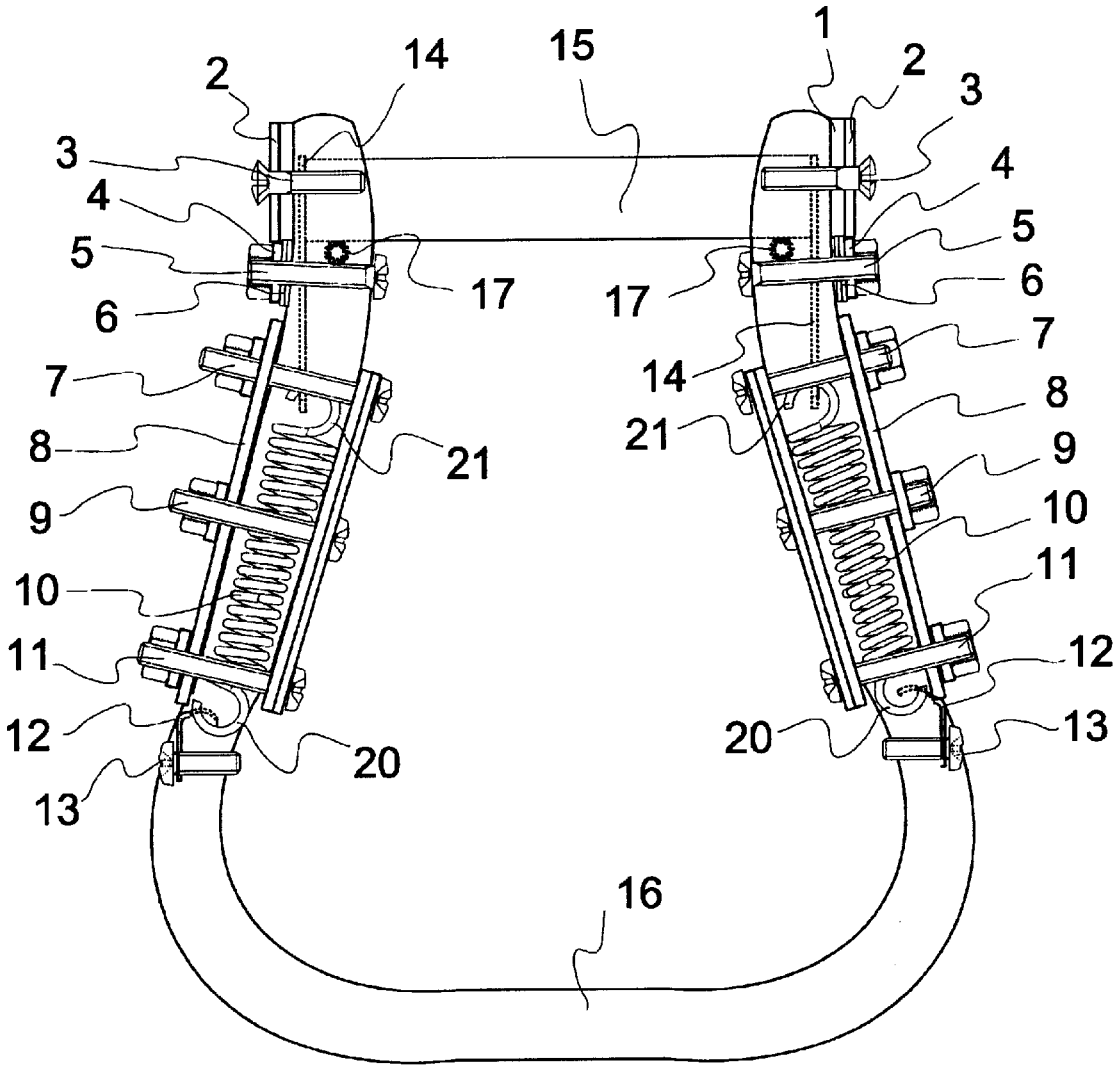
FIG. 1 is a front view of the western style stirrup comprised of internal springs.
Figure 2:
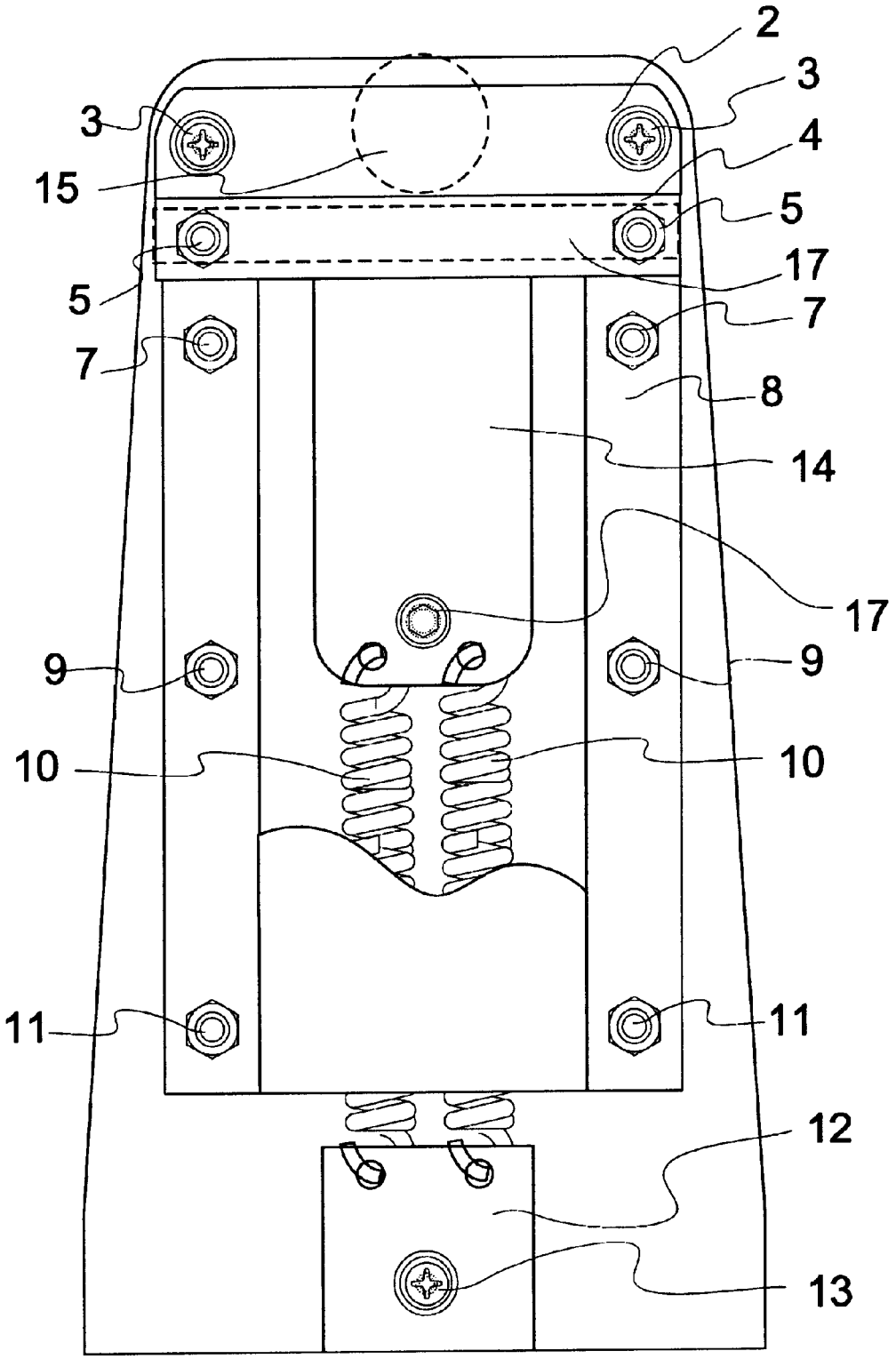
FIG. 2 is a side view of the western style stirrup comprised of internal springs.
Figure 3:
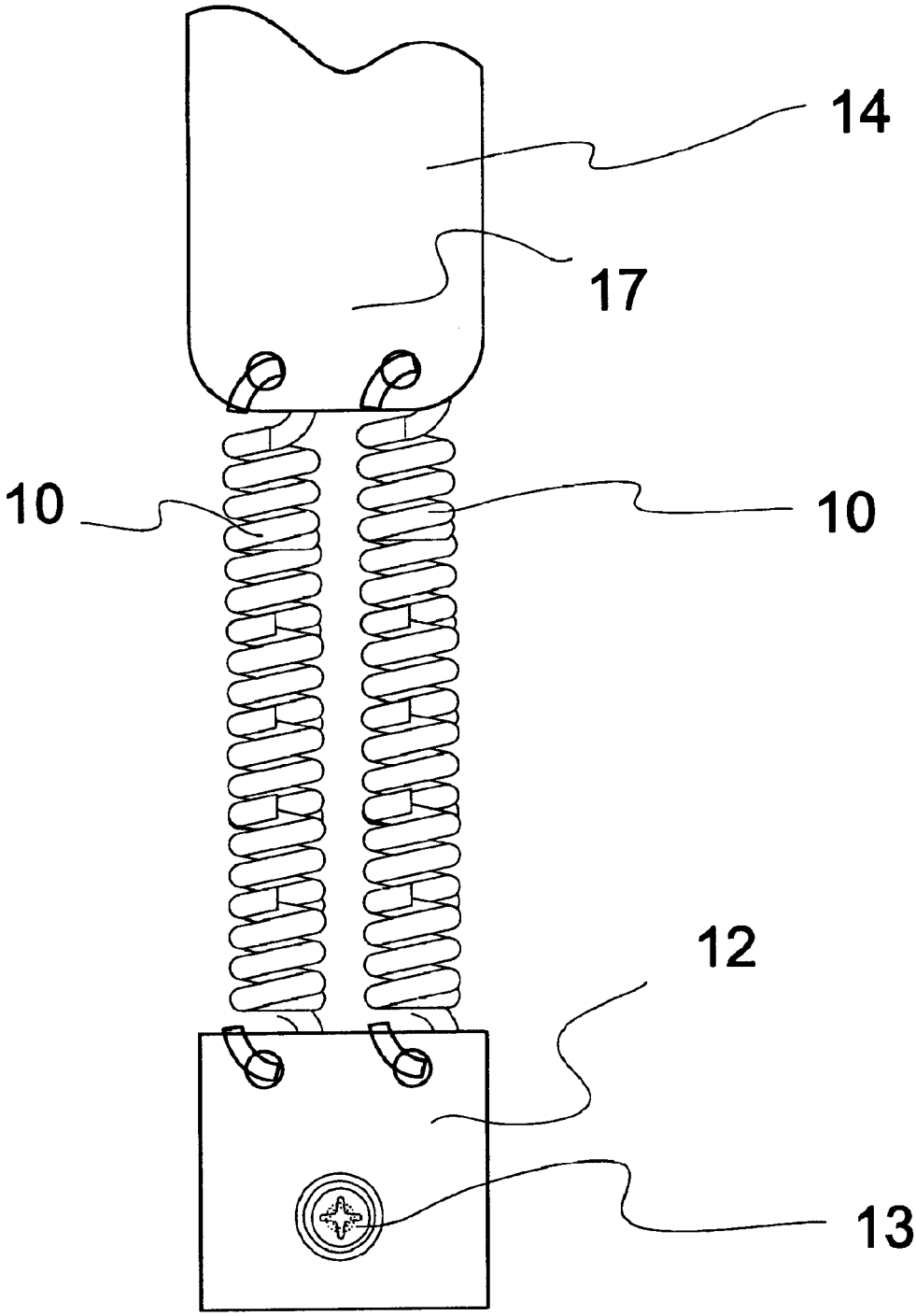
FIG. 3 is a detailed view of the internal spring system of the western style stirrup comprised of internal springs

The instant invention is comprised of a stirrup frame and the spring subassembly. To understand the function and arrangement of the stirrup, the instant invention will be described loosely in the direction in which force is transferred from the foot of the rider to the saddle.

The rider's foot rests inside the stirrup frame 16 and typically rests on the inside of the stirrup frame. The force from the rider's foot would be directed in a downward direction in the stirrup frame 16. Alternatively, force could be directed from the stirrup frame to the rider's foot in which case the force would be directed in the opposite direction in the following discussion.

Assuming that the rider's foot exerts a force on the stirrup frame 16, the force in turn is transferred through the stirrup frame 16 to the spring assembly. The spring assembly is connected to the stirrup frame 16 in a plurality of locations. Starting from the lower portion of the stirrup frame 16, the spring assembly is connected to the stirrup frame via the spring anchor 12 and the spring anchor connector 13. The spring anchor 12 is connected to the springs 10 via the lower spring hooks 20 located on the lower ends of the springs 10. The lower spring hooks 20 are connected to the spring anchors 12 by passing the lower spring hooks 20 through an aperture on the spring anchors 12 for each of the lower spring hooks 20.

A plurality of springs 10 are positioned within each side of the stirrup frame 16. The springs are located in a hollowed portion, the spring chamber, formed by the stirrup frame 16. The springs are contained in the spring chamber by the spring clamps 8. The spring clamps serve to allow free movement of the springs in a confined area so that no portion of the rider's leg, the riders clothing or the horse can be pinched by the springs 10. The spring clamps 8 are held in place by the lower spring clamp connector 11, the middle spring clamp connector 9 and the upper spring clamp connector 1.

At the upper portion of the springs 10, the upper spring hooks 21, are connected to the riser 14. The upper spring hooks 21 are connected to the riser 14 through an aperture for each upper spring hook 21 in the riser 14. The riser 14 is in turn connected to the riser bar 15 via a weld, a threaded connection means, or a non-threaded connection means. The riser bar is the portion of the instant invention that is connected to the saddle leatherwork which is in turn connected to the saddle.

In the normal position or "no-force" position, the riser bar rests on the riser stop 17. When a force is imposed on the stirrup frame such that the transferred force can overcome the tension force of the contracted spring, the springs extend and the riser bar moves away from the riser stop 17. The springs 10 provide a means for moderating the amplitude of forces imposed on the stirrup frame. The riser stop is held in place by a rubber gasket 1 and a cover plate 2. The cover plate is fastened to the stirrup frame 16 by a cover plate connector 3. The riser stop is held in place vertically via a riser stop plate 4, riser stop connector 5 and riser stop connector washers 6.

The best mode of operation of the instant invention is to have the joined stirrup frame and spring assembly wrapped in leatherwork or man made material similar in nature to leather. A leatherwork means is used to join the saddle to the stirrup via the riser bar 15. When the rider imposes a force on the stirrup, the force amplitude is modulated through the springs 10 in the spring assembly.

One preferred embodiment of the invention would be to employ four springs per stirrup, two on each side of the stirrup frame 16, to modulate the forces. Another embodiment would be to use two larger springs per stirrup. Yet another embodiment would be to use a plurality of smaller springs, more than four per stirrup.

What is claimed is:

1. A western style stirrup comprising: a frame forming a hollowed opening on the sides of the frame; a riser bar; a riser which is connected to the riser bar through a welded or threaded connection means; an internal spring assembly comprised of a plurality of springs acting in extension wherein the internal spring assembly is positioned within the hollowed portion of the frame wherein the internal spring assembly is connected to the frame and the riser bar; and a covering material that encloses the entire stirrup frame and spring assembly.

2. A western style stirrup as described in claim 1 where each spring contained in the internal spring assembly is connected to the stirrup frame via a spring hook passing through an aperture in a spring anchor which is in turn connected to the frame through a spring anchor connector.

3. A western style stirrup as described in claim 2 where the internal spring assembly was comprised of four total springs with two springs mounted within each of the hollowed portions of the frame on either side of the frame.

4. A western style stirrup as described in claim 3 where the covering material is leather material, cloth material, polymeric material or any other thin flexible resilient material.

* * * * *